United States Patent [19]

Eisbein et al.

[11] 4,443,092

[45] Apr. 17, 1984

[54] COMPACT PHOTOCOPYING MACHINE

[75] Inventors: Jüergen Eisbein, Gerlingen; Heinrich Kaufmann, Stuttgart; Kurt Moser, Gerlingen; Friedhelm Brenner, Reichartshausen, all of Fed. Rep. of Germany

[73] Assignee: Develop Dr. Eisbein GmbH & Co., Gerlingen, Fed. Rep. of Germany

[21] Appl. No.: 414,269

[22] Filed: Sep. 2, 1982

[30] Foreign Application Priority Data

Sep. 12, 1981 [DE] Fed. Rep. of Germany ..... 3136206

[51] Int. Cl.[3] ..... G03G 15/20

[52] U.S. Cl. ..... 355/3 R; 355/3 FU; 219/216

[58] Field of Search ..... 355/3 R, 16, 11, 3 SH, 355/3 FW; 219/216, 388; 432/60

[56] References Cited

U.S. PATENT DOCUMENTS

| | | | |
|---|---|---|---|
| 3,997,262 | 12/1976 | Dol et al. | 355/3 R X |
| 4,180,319 | 12/1979 | Kaufmann et al. | 355/16 X |
| 4,188,109 | 2/1980 | Idenawa et al. | 355/3 FU |
| 4,192,229 | 3/1980 | Tsunol et al. | 219/216 X |
| 4,289,395 | 9/1981 | Stelben | 355/16 X |
| 4,376,577 | 3/1983 | Okamoto | 355/3 DR |
| 4,386,841 | 6/1983 | Wakao et al. | 355/3 DR |
| 4,389,114 | 6/1983 | Westerman | 219/216 X |

*Primary Examiner*—R. L. Moses

*Attorney, Agent, or Firm*—Barnes & Thornburg

[57] ABSTRACT

A compact, readily servicable, office photocopying machine is provided which has pivotally connected upper and lower housing parts. A paper cassette receiver for holding a stack of coated photosensitive copying paper sheets is located at the bottom of the lower housing part. The lower housing part also operably supports a charging station, an exposing station, a developing station, and a fixing station arranged above and within the vertical projection of the stack of sheets in the cassette receiver. A sheet separating station for separating individual sheets from the cassette and a paper reversing guide are provided for transferring individual sheets from the cassette to the charging station. The exit end of the paper reversing guide and the separating station are also arranged above and within the vertical projection of the stack of sheets in the cassette receiver. A slide block with a holder for an original to be copied and an optical system are operably supported at the upper housing part.

38 Claims, 14 Drawing Figures

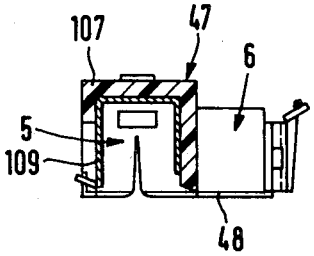
Fig. 9
Fig. 10
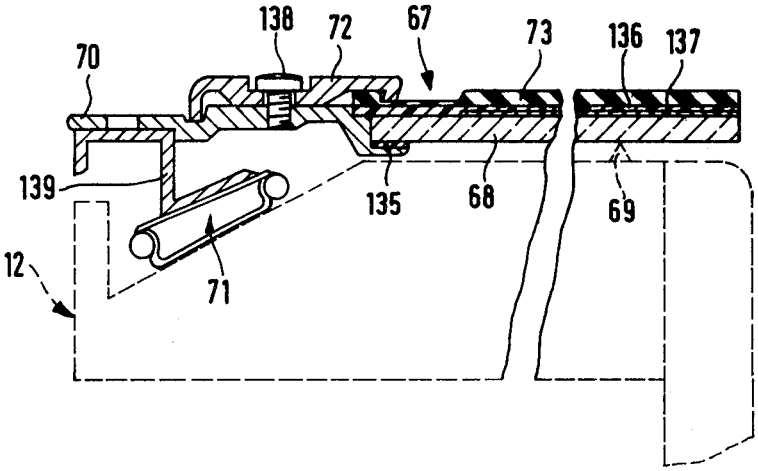

COMPACT PHOTOCOPYING MACHINE

BACKGROUND AND SUMMARY OF THE INVENTION

The invention relates to a copying machine, especially a small photocopying machine for an office. The photocopying machine of the invention has a receiver for a cassette which carries a stack of coated photo-sensitive sheets, a separating station, a charging station, an exposing station provided with an exposing window, a developing station provided with a magnetic roller, and a fixing station provided with a pair of pressing rolls, all arranged in a lower housing part. The machine of the invention also has an optical system and a receiving slide block for an original to be copied arranged in an upper housing part, the upper housing part being movably supported at the lower housing part.

In previously contemplated photocopying machines the receiver for the stacked paper cassette and the separate stations or devices are arranged one behind the other on a rail so that the separate devices are visible and accessible upon the opening of the machine housing. This arrangement provided a machine that exhibited a cross-sectional shape corresponding to approximately 2 ½ times the length of the format of the paper to be copied. In practice the trend has been toward the positioning of these copying machines at personnel work stations so that the required travel to a centrally located copying machine is spared. In order for the machines to be placed without hindrances in the area of the workstations there is a requirement for the smallest possible and most compact copying machine that requires little space.

The invention relates to the problem of providing a copying machine of the above mentioned kind, which is constructed as small and compact as possible, without impairing the servicing accessibility to the separate operating devices. This problem is solved according to preferred embodiments of the invention by providing that the receiver for the cassette is arranged on the housing floor and parallel thereto, with a paper reversing guide connected to the cassette receiver and exhibiting a sheet turning angle of approximately 220 degrees in the upward and opposite direction with respect to the cassette receiver. A charging device and exposing station follow the paper reversing guide with a downwardly, inclined travel path therethrough with respect to the housing floor. The end of the paper reversing guide, the charging device, the exposing device or station, the developing station and the fixing station are arranged one behind the other within the upward vertical projection of the length of the sheets in a cassette held in the cassette receiver.

Through this above-noted construction, a copying machine is produced which exhibits an area which is not much larger than the size of the format to be copied, corresponding to the format of the stack of papers, so that an exceptionally small and compact copying machine is provided. Because the separate elements or stations, which in any event require examination or servicing, are arranged one behind the other in the copying machine housing lower part, a good accessibility and ease of servicing is guaranteed. Additionally, the arrangement provides for a very short transport path for the copying paper, thus removing the need for intermediate paper guides and additional paper transport elements so that construction costs are minimized.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 9 is a sectional view along the line IX—IX of FIG. 8;

FIG. 10 is a partial schematic sectional view in the cross direction through a slide block and its sliding guide which operates as a receiver for the originals to be copied of the machine of FIG. 1;

DETAILED DESCRIPTION OF THE DRAWINGS

Figure 1:
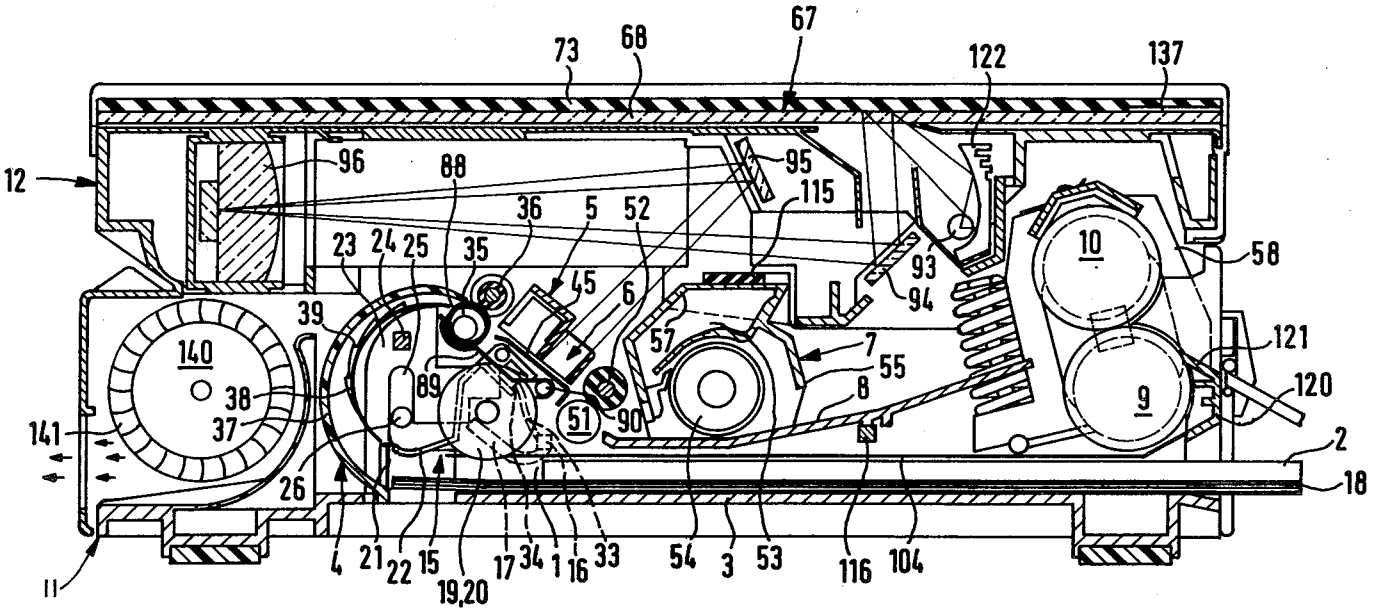
FIG. 1 is a simplified schematic sectional view through a copying machine constructed in accordance with the present invention.
Figure 2:
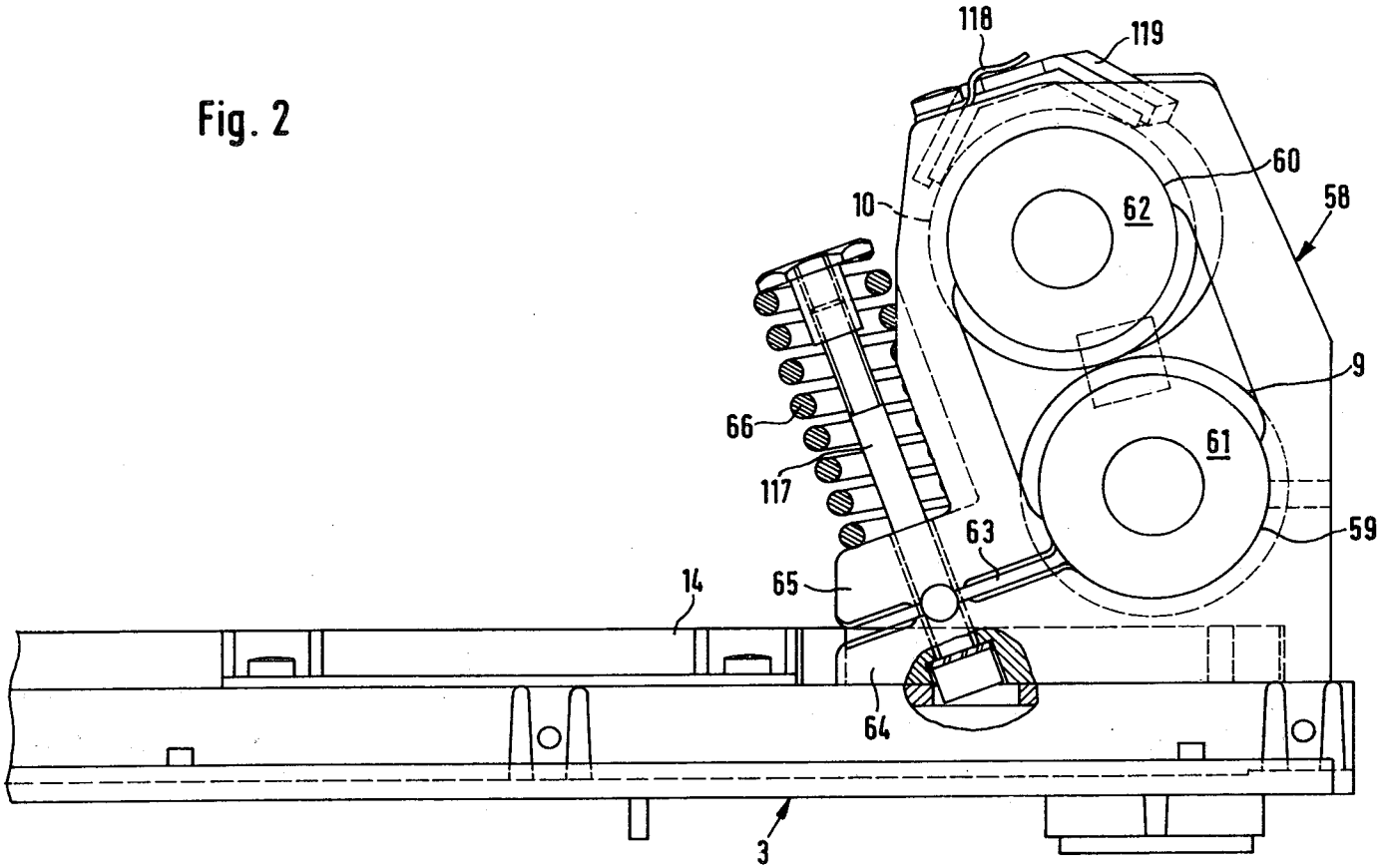
FIG. 2 is a partial sectional side view of the machine of FIG. 1, showing the floor plate of the machine housing lower part and the fixing station attached thereto.
Figure 3:
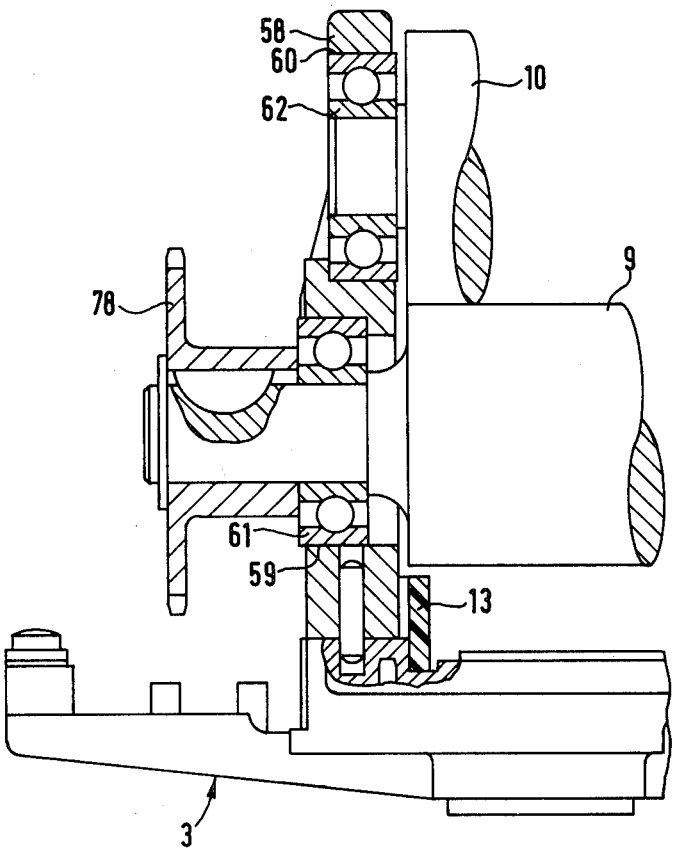
FIG. 3 is a partial sectional view through a bearing block and bearings for the pressing rolls of the fixing station of the machine of FIG. 1.

The copying machine according to FIG. 1 possesses a lower housing part 11 and an upper housing part 12 which are connected to one another through a pivot axis so that the upper housing part 12 is movable away from the lower housing part 11. In the lower housing part 11 a receiver 1 for a cassette 2 is provided which extends immediately above the and parallel to the floor. The machine lower housing part 11 includes a floor plate 3 formed as a spray cast metal part, which floor plate 3 forms the underside of the receiver 1. The receiver 1 is bordered on the sides by plastic members 13 and 14 which are screw threadedly attached to the floorplate 3. The receiver 1 is bordered at the top by means of a thin metal plate 104, which plate 104 is attached to the lower housing part 11, adjacent the opening for the receiver 1(right side of the FIG. 1 illustration). In order for the stack of papers in the cassette 2 to have free ends in the area of a separating station 15, the end of the cassette which slides into the copying machine is cut or slit from the floor upward. The thin elastic bendable plate 104 extends into the area of the separating station 15. The bearing or support for the plate 4 is bordered from above by the 4-sided shaft 16 belonging to the separating station 15.

Figure 4:
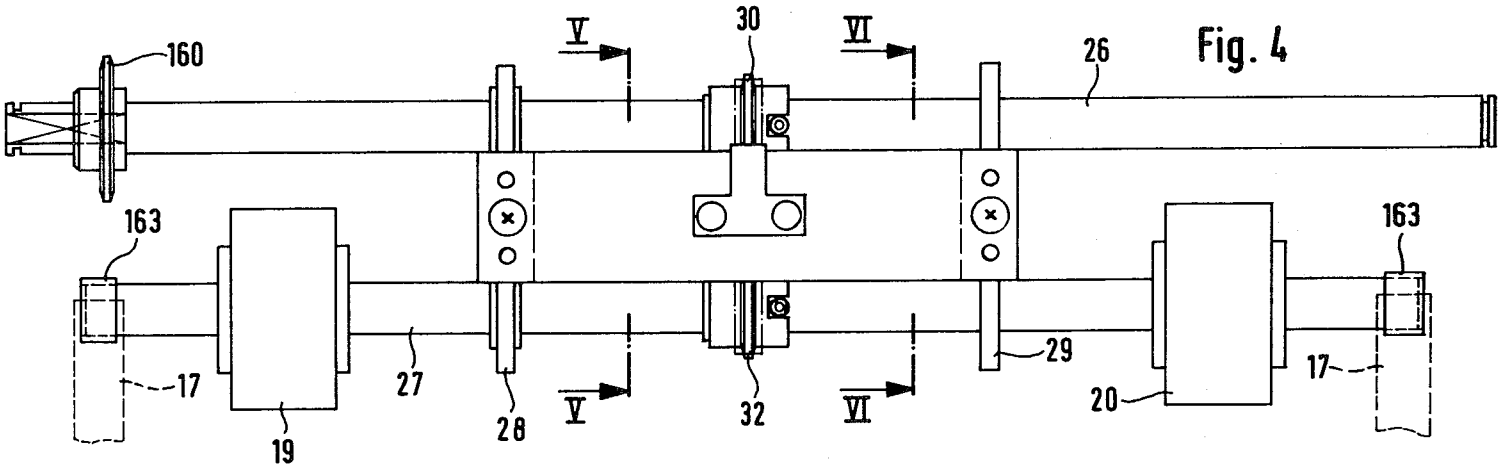
FIG. 4 is a partial top view showing the arrangement and the drive for the separating rolls of the separating station of the machine of FIG. 1.
Figure 6:
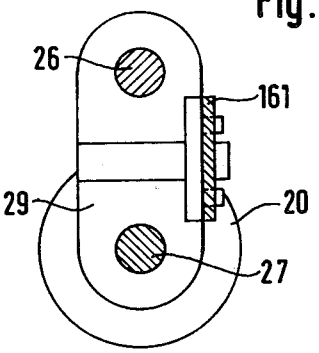
FIG. 6 is a sectional view along line VI—VI of FIG. 4.
Figure 5:
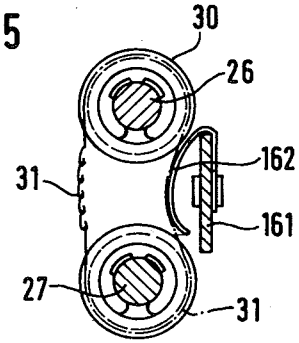
FIG. 5 is a sectional view along line V—V of FIG. 4.
Figure 7:
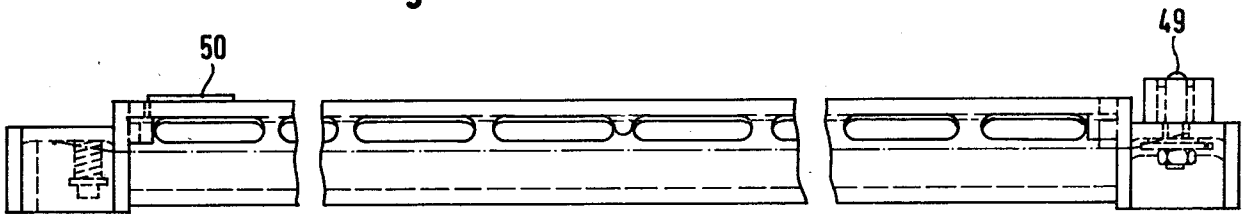
FIG. 7 is a partial top view showing the paper transporting device of a charging station, which is combined with an exposing window of the machine of FIG. 1.
Figure 8:
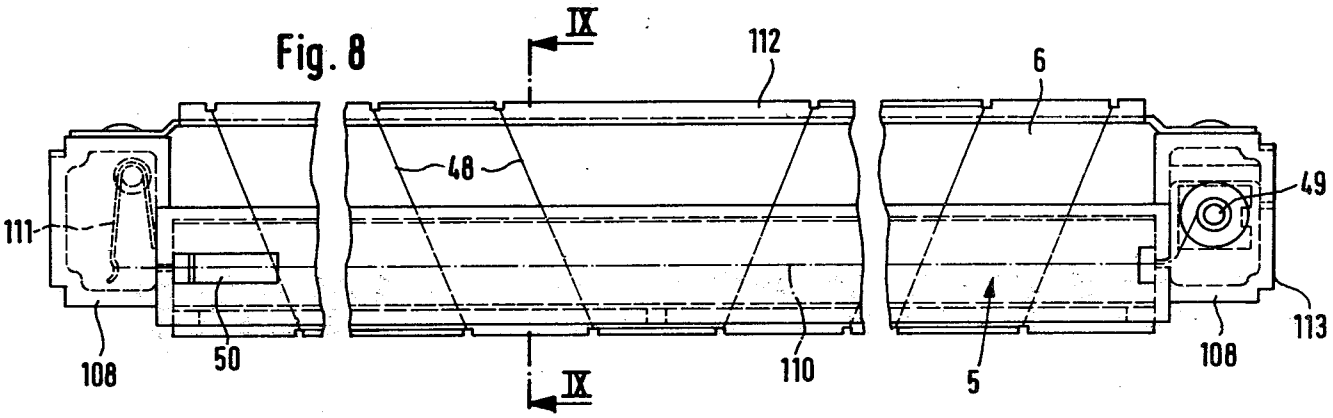
FIG. 8 is a view from above of the combined unit of FIG. 7.

The separating station 15 includes 2 separating rollers 19 and 20 made of rubber or other elastic material (see also FIGS. 4 through 6). Separating rollers 19 and 20 are driven and are lowerable to accommodate separating sheets from the sheet stack 18. The separating station further includes corner separators 21 constructed with vertical plate parts which border the corners of the stack of sheets and a triangular shaped plate part which engages the stack of sheets from above. The corner separator 21 are components of two plates 23, which can be lowered from the FIG. 1 shown raised position so that the triangular shaped plate parts lie closely adjacent the stack of sheets 18. Plates 23, which through a 4-cornered cross shaft 24 are binded together, are located in an opening in the floorplate 3 and on a shaft 26 which is vertically guided in slotguide 25. These plates 23 and the corner separators 21 are together with the separating rolls 19 and 20, shown in FIG. 1 in its raised position, raised and lowered by a lifting device.

The lifting device consists of the above mentioned rotatable 4-sided shaft 16, on which two lever arms 17 are mounted. The lever arms 17 grasp and receive from underneath the shaft 27 associated with the separating rolls 19 and 20 (see FIG. 4). The 4-sided shaft 16 is raised and lowered in a pre-determined time sequence explained in more detail below. Two sheet springs 33 are mounted on the 4-sided shaft 16. These sheet springs 33 extend into opening 34 and grasp the paper hold-down 22 which is arranged to be pivotal about a pivot axis so that its paper contacting part is lowered so far upon the raising of the corner separators and the separating rollers 19 and 20, that the sheets of the sheet stack 18 cannot be placed over the area of the corner separators. When the separating rollers 19 and 20 and the corner separators are lowered by means of the turning of the 4-sided shaft 16, the sheet-springs 33 lift the paper hold-down 22 upwardly.

A paper turn-around or reversing guide 4 is provided adjacent the separating station 15 for guiding and turning the sheets of paper through a reverse angle of approximately 220 degrees from their position where they are taken-up from the cassette 2. The cassette 2 is so filled with the sheets of paper that the coated sides of the pages face downwardly so that the separating rollers 19 and 20 engage the uncoated reverse sides of the sheets. The reversing guide 4 includes an outer shell 37 and an inner shell 38. The outer shell 37, on which the sheets are guided with their coated sides, is constructed of plastic. The shell 37 is further provided with ribs extending in the transport direction so that a very small reduced sliding surface is in contact with the paper. The inner shell 38 is made out of aluminum sheet metal which has stamped diagonal ribs 39 of sawtooth roof type configuration whereby the paper sheets are guided only on the tips of these cross ribs 39. The outer shell 37 is provided with side rims or borders which are connected to the inner shell 38 by means of screws not shown in detail, so that the reversing guide 4 is formed as a closed channel. The distance between the two approximately cylindrically shaped shells 37 and 38 is reduced continuously in the transport direction so that a diminishing size channel results.

Figure 14:
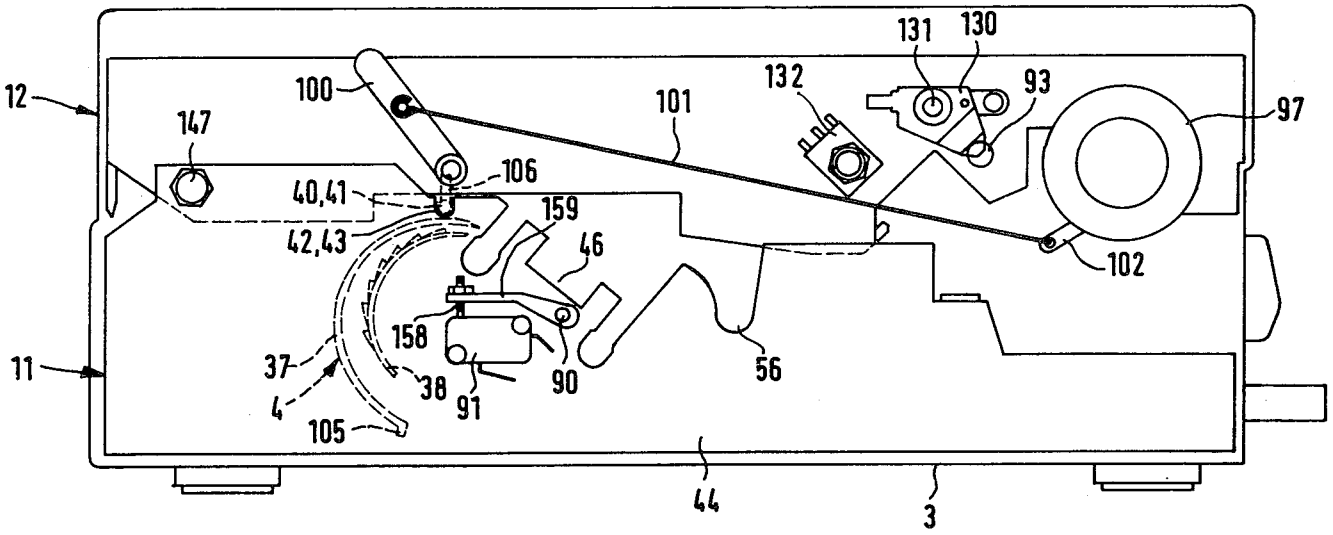
FIG. 14 is a simplified partial view of the copying machine of FIG. 1, from the servicing side thereof.

Immediately following the reversing guide 4, a pair of drawing off rollers 35 and 36 are provided that are driven at a slightly faster speed than the separating rollers 19 and 20. The separated sheets are initially pushed along the outer shell 37 of the reversing guide 4 by the separating rollers 19 and 20. When the sheets are taken over by the drawing off rollers 35 and 36, they are lightly pulled over the tips of the cross ribs 39 of the inner shell 38. The outer shell 37 of the reversing guide 4 is provided with two side projections 40 and 41 in the area of the upper end (FIG. 14). By means of these projections 40 and 41 the outer shell 37 is hanged in the openings 42 and 43 of sidewalls 44. Sidewalls 44 are constructed from sheet metal plates which are fastened to the floorplate 3 of the housing lower part 11. The lower end of the outer shell 37 is provided with vertically downwardly extending protusions 105 (FIG. 14) which are inserted into openings in the floorplate 3. The reversing guide 4 can be removed in a simple manner as a unit in the upward direction from the housing lower part 11. The outer shell 37 of the reversing guide 4 is furthermore provided with a vertically jutting fishplate 106 in the area of its upper end, which fishplate 106 juts into the housing upper part 12 when the housing parts are closed together, to thereby activate a switch arranged to connect the electrical operating circuit. The copying machine can therefore only be activated when the housing is closed and when the reversing guide 4 is in position.

The drawing off roller pair 35 and 36 includes a metal roller 35 and a spring pressed rubber roller 36. A charging station 5 is connected to and arranged adjacent to the drawing off roller pair 35 and 36. Charging station 5 is constructed as a unit along with a light exposing window 6 located immediately adjacent the charging station 5. A common guideplate 45 extends adjacent the charging station 5 and the exposing window 6. The charging station 5 and the exposing window 6 are disposed in a common housing 47 which has a plastic body 107. The plastic body 107 includes a middle section and two endparts 108. In the middle section there is a charging plate 109 with a U-shaped cross section (FIG. 9) which is connected with contact 50 formed as an upwardly extending fishplate with respect to the housing 47. A Tungsten wire 110 is stretched across the middle section inside of the charging plate 109. Tungsten wire 110 leads to a contact 49 at a high voltage rectifier in the endpart 108. The other end of the Tungsten wire 110 is connected to the hinge leg of a hinge spring 111, arranged in the other endpart 108.

A cross sheet metal part 112 extends between the endparts 108 and, with the middle part, forms an upwardly and downwardly open frame which borders the exposure window 6. Nylon threads 48 are hanged in hooked formed parts at the charging plate 109 and the cross plate 112, at least in the region of the guiding plate 45. The thin nylon threads 48 guide an incoming sheet in the area of the charging station 5 and the exposure window 6 very exactly. Because of the very close spacing of the charging station 5 and the exposure window 6 adjacent one another there occurs no loss of charge between the charging station 5 and the exposure window 6. Thus the loading or charging current can be maintained relatively low and still maintain saturation. Further, there is only a very small sized ion cloud which leads to a very minimal ozone development.

Both endparts 108 of the plastic body 107 are provided with side protusions 113 so that the unit can be inserted from above into recesses 46 of the side walls 44 of the housing lower part 11 (see FIG. 14 for a showing of sidewall 44 and opening 46). The housing upper part 12 is provided with spring contacts engageable with the contacts 49 and 50 so as to assure the operability of the machine. The guideplate 45 is also placed in the same openings 46, with the openings 56 including corresponding abutments. Both endparts 108 of the plastic body 107 are disposed slightly above the level of the tension nylon threads 48 and lay on the guideplate 45. In this way the guideplate is secured in an exact guideslot position in the opening 46.

Immediately following the construction unit including the charging station 5 and the exposuring window 6 are a pair of transport rollers 51 and 52. The transport roller pair 51 and 52 is disposed in line with the transport direction defined by the draw off rollers 35 and 36 and the guideplate 45. The transport rollers 51 and 52 are driven with a slightly higher rotational speed than the draw off rollers 35 and 36 so that the sheets traveling in the region of the charging station 5 and the exposure window 6 are optimally tensioned. From FIG. 1 it is easily seen that the complete separating station 15 is arranged inside of the space between the end of the receiver 1, the reversing guide 4 and the unit formed as the charging station 5 and the exposure window 6.

The transport rollers 51 and 52 exhibit a paper travel direction which is inclined onto a guideplate 8 which connects with a developing station. The guideplate 8 includes a first section which extends parallel to the receiver 1 and the floorplate 3 up to the position of magnetic roller 54. The second part of the guideplate 8, which begins under the magnetic roller 54, is slightly inclined in the upward direction and leads to the pressing rollers 9 and 10 of the fixing station. The guideplate 8, which preferably is manufactured of pressurized metal casting, is advantageously connected with a housing 55 that receives the magnetic roller 54 and forms a reservoir 53 for toner material. The region of the reservoir 53 is open in the upward direction to accommodate a filling opening. This region is covered by a cover 57 which is fixed to the upper housing part 12 by means of an elastic base 115. Upon opening movement of the housing upper part 12, the filling opening of the reservoir 53 is open, while with a closed housing, this opening is securely sealed. The housing part 55 is provided with metal inserts for accommodating the bearings for the magnetic roller. By means of these metal inserts, the developing station is insertable from above into the upwardly open opening 56 of the sidewalls 44 (FIG. 14) of the machine housing lower part 11. The securing of the development station 7 in place results from the pressure from the upper housing part 12 via the cover 57 and the elastic base 115 attached thereto. A cross strut or support 116 is provided which the guideplate 8 is furthermore supported by, thus guaranteeing a secure holding of the assembly.

Following the developing station 7 is a pair of pressing rollers 9 and 10 of a fixing station. Pressing rollers 9 and 10 are arranged one above the other in an inclined plane which extends perpendicular to the extension of the exit section of the guideplate 8. The lower pressing roller 9, which is provided with a driving gear wheel 78, is arranged to extend at a right angle to the travel paper path direction. The upper pressing roller 10, disposed opposite the lower pressing roller 9, is disposed at an angle of about 1 degree to the axle of the roller 9 in order to counteract and balance the bending experienced by the rollers during operation. Pressing rollers 9 and 10, which are constructed as massive steel rollers, are carried by roller bearings 61 and 62 in bearing blocks 58 disposed as single units at each end of the rollers. The bearing blocks or supports 58 are provided with two half cylindrical bearing seats for receiving the outer rings of the roller bearings 61 and 62.

The bearing supports 58 are manufactured as case hardened castings. After the casting is formed, a slot 63 is cut-out of the respective bearing blocks 58, which slot 63 is disposed in the region of the bearing seat 59 for the lower pressing roller 9. The slot 63 extends approximately perpendicular to the extension between the bearing seats 59 and 60 of the bearing blocks 58. The sides of the slot 63 are formed with protusions 64 and 65, which by means of a screw 117 and a compression spring 66 are resilently connected. The screw 117 and the spring 66 extend parallel to the extension between bearing seats 59 and 60. Both pressing rollers 9 and 10 move with respect to one another slightly during operation with paper sheets passing therethrough, which movement is accommodated for in the bearing supports 58 by means of the elastic arrangement. The movement occurs in a definite region between the upper bearing seat and the lower bearing seat which is connected together by the screw 117 and the pressure spring 66 by way of the extensions of the bearing block 58. The elastic deformation of the bearing block 58 and the affected region is reduced due to the movement permitted at the slot 63 between the relative parts of the bearing seat 59 along the bearing outer ring of the ball bearings 61, dampened by the screw 117 and pressure spring at the extensions bounding the slot 63. A bending in the region of the bearing seats 60 is therefore prevented. Above on the bearing blocks 58 clamping holders 118 are provided which receive a cleaning stripper 119 which has a felt covering engagable with the upper pressing roller 10. Furthermore, a cleaning stripper 120 is arranged on the bearing support 58, with several springlike sharpened cut-out tongues 121 laying on the circumferance of the lower pressing roller 9. This stripper 120 serves further for the fastening of the cover plate 104 covering the receiver 1 for the copying paper.

Figure 11:
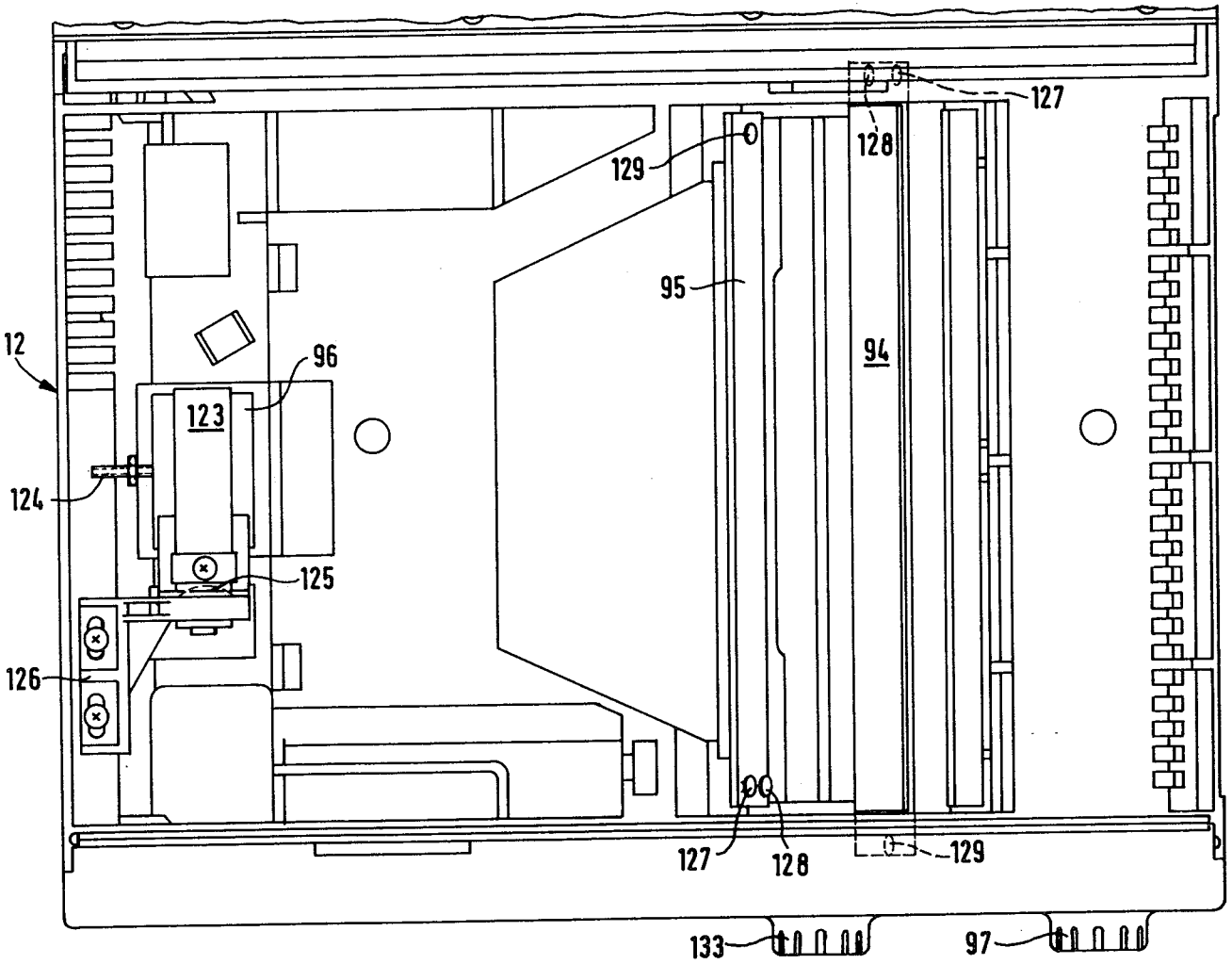
FIG. 11 is a schematic view of the copying machine housing upper part with the separate parts of the optical system of the machine of FIG. 1.

The housing upper part 12 is dimensioned with an opening or space in the region of the pressing roller 10 so that the entire height of the copying machine is only insignificantly higher than the height required by the two pressing rolls 9 and 10. In the remaining region of the upper housing part 12, the optical system is provided. A halogen lamp 93 with an adjacent elliptically curved reflector 122 is arranged near the region of the upper pressing roller 10. The reflector 122 directs the light of the halogen lamp 93 to a light slot in the upper side of the upper housing part 12, which light is then directed by means of mirror 94 to objective glass or lens 9 so that the light is directed via a further mirror 95 to exposing window 6. The objective lens 96 (FIG. 11) is held by a tensioning band 123 and an adjusting screw 124 for accommodating adjustment of the focal length in the axial direction. The tensioning band 123 is secured to a ball cap shaped guiding part 125 movably disposed on a ball head of a holder 126. The holder 126 is slidably adjustably fixed to the upper housing part 12. The objective lens 96 can therefore be adjusted in a simple manner in the axial direction for adjusting the focal length and also in cross directions and in its inclination.

Both mirrors 94 and 95 are adjustably installed at the housing upper part 12, which upper part 12 is advantageously constructed of spray or pressure cast metal. Each mirror 94, 95 is held by three adjusting screws 127, 128, and 129 so that by means of adjustment of all of these screws 127, 128, and 129 as well as separate ones of the screws, the necessary positioning of the mirrors 94 and 95 can be exactly adjusted.

The halogen lamp 93 is also to a certain extent adjustable. The halogen lamp 93 is held by two contact supports at the upper housing part 12, of which the contact 130 (FIG. 14) is swingable about a fastening screw 131 so as to accommodate the adjustment of the position of the halogen lamp. The brightness of the halogen lamp 93 is adjustable by way of a phase controller. This adjustment is effected by means of a potentiometer 132 which is adjustable by means of turning knob 133 extending through the servicing side of the machine (see FIG. 11).

The machine housing upper part 12 carries a lengthwise moveable slide block 67, which slide block serves to accommodate receipt of original sheets to be copied. The slide block 67 includes a glass plate 68 which is received and carried at a carrying rail 70 by means of an adhesive band 135 (see FIG. 10). A pressing cover 73 lays on top of the glass plate 68, which cover 73 is formed of rubber like or elastic material and is provided at its underside with a white plastic coating. A stop or recess 137 is provided on the glass plate 68 at the right side as shown in FIG. 1 for accommodating the placement of an original to be copied. The pressure cover 73 includes a thin section in the region of its attachment at the carrying rail 70, which thin section serves as a hinge. The glass plate 68 and the pressure cover 73 are connected to the carrying rail 70, together with a clamping ledge 72, by means of clamping screws 138. The longitudinal guidance for the glass 68 results at one side of the housing upper part 12 by means of a cut-out sharpened guiding rail 69 and on the other side by means of a sliding guide 71. The carrying rail 70 is connected with the sliding guide 71 by means of a profile 139 which is arranged at an angle inside a groove at the upper side of the housing part 12.

Figure 12:
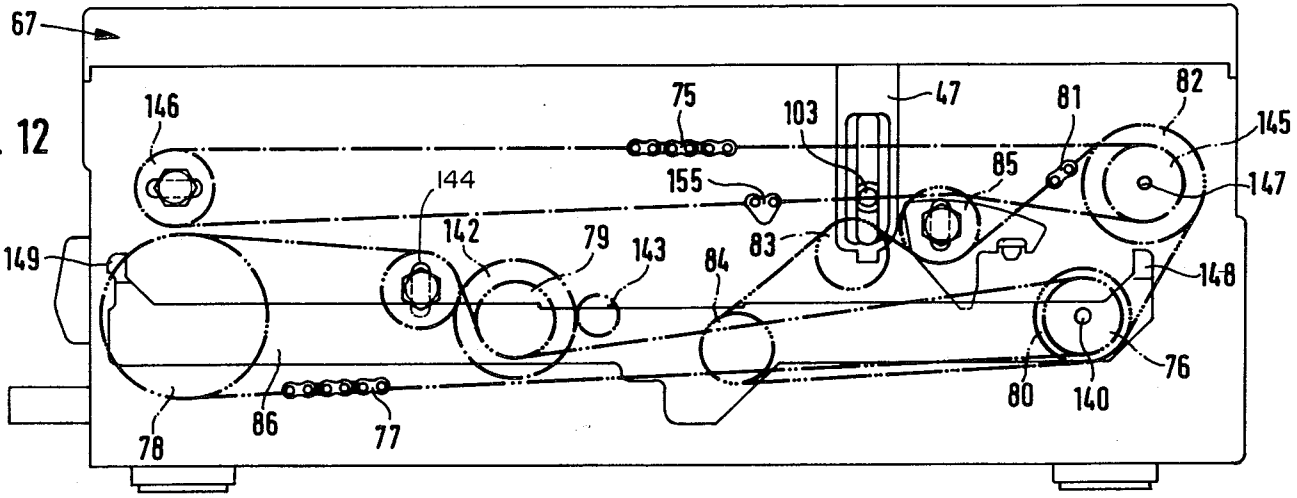
FIG. 12 is a schematic part sectional side view, taken in a direction from behind the plane of FIG. 1, illustrating the chain drives serving to drive the machine of FIG. 1.

The copying machine is provided with only one driving motor 140, by which all of the movements as well as the paper transport and the exposing apparatus are handled. The driving motor 140 is disposed in the housing lower part 11 in a region opposite the end region where the pressing rollers 9 and 10 are situated. Since FIGS. 12 and 13, for example, are views taken in a direction from behind and upwardly out of the paper from the FIG. 1 illustration, the motor 140 appears at the left side of FIG. 1 and the right side of FIGS. 12 and 13. The motor is provided with two driving trunions, whereby one driving trunion carries a fan wheel 141 of a cross flow fan. In this area adjacent the driving motor 140 and the fan wheel 141 there is located a not illustrated high tension rectifier for the charging station 5.

The driving motor 140 drives the lower pressing roller 9 and the magnetic roller 54 of the developing station 7 by means of a first chain drive. The driving elements are located at the backside of the housing wall at the servicing side of the machine housing, outside of the side walls of the housing lower part 11 in a region which is covered by a cover member (spaced laterally from the vertical projection of the originals being copied and the travel path of the sheets passing through the machine). The driving motor 140 is provided with a first gear wheel 76, which by means of chain 77 drives gearwheel 78 for the lower pressing roller 9 and gearwheel 79. Gearwheel 79 has a toothed wheel 142 rotably fixed therewith for driving magnetic roller 54 by means of the connected toothed wheel 143. A tensioning wheel 144 is provided for tensioning the chain 77.

The driving motor 140 drives a second gearwheel 80 connected by chain 81 to gearwheel 82, gearwheel 83, and gearwheel 84. Furthermore, a tensioning gearwheel 85 is provided for this chain 81. The gearwheel 83 is arranged for driving of the drawoff rollers by means of an interposed electrical magnetic coupling. The gearwheel 84 is rotatively fixed to the transport roller 51.

A third chain drive is connected to the second chain drive, for driving the slide block 67 by means of the chain 75. The chain 75 extends over driving gearwheel 145 and a reversing and tensioning gearwheel 146. The gearwheel 145 is coaxial to the gearwheel 82 and rotatably fixed therewith. The axle of the gearwheels 145 and 82 furthermore form the pivot axis 147 about which the upper housing part 12 is pivotable with respect to the lower housing part 11.

At the slideblock 67, that means at the carrying rail 70, a bracket or connecting link 47 is provided, in which a carrying lug 103 of the chain 75 is engagable, so that the slideblock 67 moves back and forth upon the movement of the chain 75. The reversing of the movement direction results when the carrying link 103 travels around the gearwheels 147 and 146. A carriage 86 is provided in the movement path of the bracket 47, which carriage 86 is slidable in the longitudinal direction of the machine. Carriage 86 includes two protusions 148 and 149, which protusions are engaged by bracket 47 at the reversing positions of the slideblock 67, whereby the carriage 86 is moved.

Figure 13:
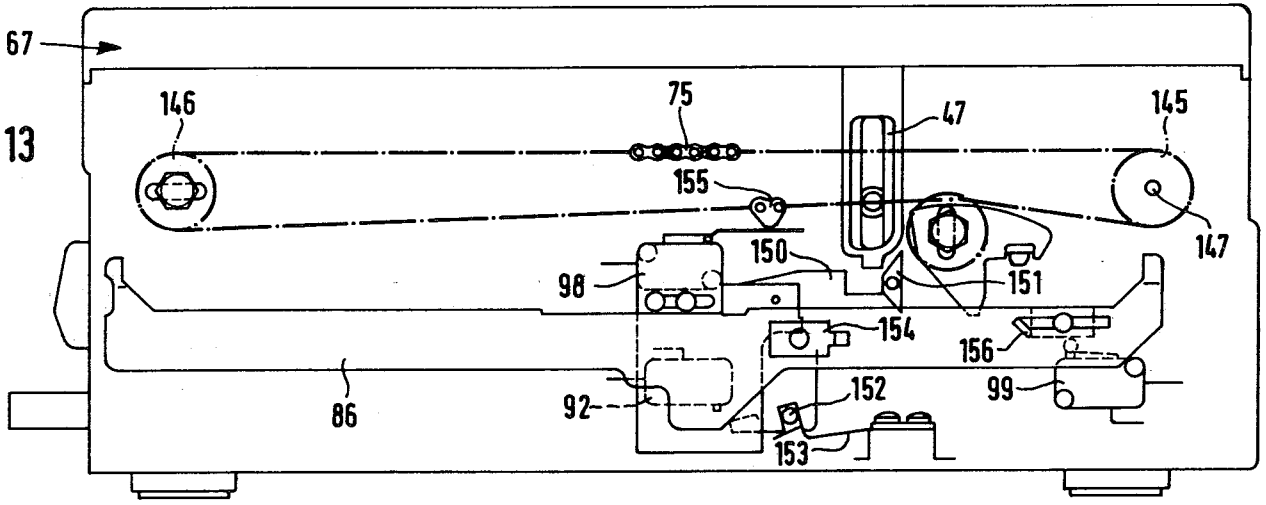
FIG. 13 is a view similar to FIG. 12 showing the switching elements dependent on the movement of the slideblock of the machine of FIG. 1.

The bracket 47 also activates a tip lever 150 which belongs to the lifting device for the separating rollers 19 and 20 and the corner separators 21. The tip lever 150 possesses a hook portion 151 which is carried in only one of the movement directions of the bracket 47, namely (FIG. 13) in the direction in which the slideblock 67 travels to its start position. The tip lever 151 engages a part 152 which is connected with 4-sided shaft 16 by means of lever arms and turns in order to raise and lower the separating station 15. The tip lever 151 is secured by a stopping spring 153 in the FIG. 13 illustrated position, in which the separating station 15 is in the raised position. A pick-up catch 154 is provided on the carriage 86 which swings the tip lever 150 away from its given position when it previously has been brought into the other position by the bracket 47. A microswitch 98 is also activated by means of cam 155 carried by the chain 75 dependent upon the movement and the position of the slideblock 67.

By way of the carriage 86 a further microswitch 99 is controlled by the attachment 156. This microswitch 99 serves for activating the halogen lamp 93 and the high voltage rectifier for the charging station 5. By means of the tip lever 150, a further microswitch 92 is controlled. A further switch element is arranged as a so-called ring switch on the driven draw-off rolls. This ring switch is connected as a ring 88 which runs loosely in a groove at draw-off rollers 35 and 36, the position, of ring 88 being determined by a switch arm 89 and carried on a switch shaft 90, which activates one of the microswitches 91 arranged at the copying machine front side (FIG. 14) by means of a further switch arm 159 which is adjustably positioned by adjustable screw 158.

The driving motor 140 is started by means of a start switch 97, which simultaneously serves as the copy selection switch and which is arranged on the servicing side of the copying machine. With activation of the start switch 97, the driving motor 140 is started. Then the chains commence to run. The chain cams 155 leave the microswitch 98 which had initiated the driving motor. With the slideblock 67 movement (FIG. 13 in the leftward direction), the bracket 47 activates the tip lever 150 so that the same jumps out of its shown position in FIG. 13 and the separating rollers 19 and 20 and the corner separators 21 are lowered down to the paper stack 18 by means of the rod 152 activated lifting apparatus. Simultaneously the microswitch 92 is activated, which switches on the electromagnetic coupling of the driven draw-off roller 35, so that this runs together with the separating rollers 19 and 20. The sheet of paper taken from the paper stack 18 by the separating rollers 19 and 20 travels over the paper reversing guide 4 to the draw-off rollers 35 and 36. The incoming paper edge activates the there positioned ring switch 88 in a manner that the electromagnetic coupling of the driven draw-off roll 35 is shut-off by the microswitch 91. The paper sheet is then in an exact predetermined position.

When the slideblock 67 reaches its first turning point, the bracket 47 takes the carriage 86 with it and shoves it from the FIG. 13 illustrated ground position to the other end position. Thereby the microswitch 99 is activated by the part 156 so that the halogen lamp 93 and the high voltage rectifier are turned on. Simultaneously the protrusion 154 of the carriage 86 activates the tip lever 150 which is then brought back to the FIG. 13 illustrated ground position. Thereby the coupling for the driven drawoff roll is again switched on by means of microswitch 92 while the separating rollers 19 and 20 and the corner separators are lifted again to the exit position of the paper stack 18. At this turning point, the slideblock 67 reaches the position in which the light slot of the machine housing upper part 12 is disposed at the beginning of the original to be copied, that means adjacent the stop 137 of the glass plate 68. Now the slideblock 67 begins its actual pass (travel path), by which the sheet runs through in syncronization to the slot movement at the exposure window 6. When the slideblock 67 reaches the other turning point, the bracket 47 activates the carriage 86 in a manner that the carriage 86 is returned to the FIG. 13 illustrated ground position. In this ground position the protrusion 156 switches the microswitch 99 in a manner that the halogen lamp 93 and the high voltage rectifier are shut-off. The slideblock 67 then runs back to the ground position in which the microswitch 98 is activated by means of the chain cam 155, which then shuts off the driving motor. During the return run of the slide block 67 to the ground position, the copy is fixed in the press rolls 9 and 10 and transported to a copy deposit place.

Upon the return running of the slideblock 67 to the ground position, the start switch 97 is switched backwards one step, which means for one copy number, by means of a switch lever 100 which is positioned underneath adjacent the glass plate 68 and is so arranged that it runs along the edge of the glass plate during the copying process. The switch lever 100 is spring loaded and connected by connecting rod 101 with a return position lever 102 of the start switch 97. In the event the preset number of copies is not reached, which means the start switch 97 is not returned to its null or zero position, the microswitch 98 is over run so that after the return running to the ground position a new working cycle begins. The microswitch 98 finally switches the driving motor off only when the preset number of copies has been reached and the start switch 97 has returned to its null position.

The driving of the separating rollers 19 and 20 is controlled by the driving of the draw-off roller 35. Draw-off roller 35 is provided on the side opposite of the coupling, which is on the servicing side of the machine, with a gear wheel 160 rotatably fixed with the driving shaft 25 and driven by means of a chain (FIGS. 1 through 6). Two swing arms 28 and 29 are supported at this driving shaft 26, which swing arms support the driving shaft 27, which driving shaft 27 carries separating rollers 19 and 20 rotatably fixed thereto. Both swing arms are connected together by a cross traverse member 161. The driving shaft 26 is rotatably fixed with a further gear wheel 30 which drives a gear wheel 32 by means of a chain 31, arranged on the shaft 27 for the separating rollers 19 and 20. A tension spring 162 is provided on the traverse 161 for the chain 31. The levers 17 of the raising and lowering apparatus grasp the shaft 27 at the end extensions thereof beyond the separating rollers 19 and 20. The levers 17 are moveable by means of the 4-sided shaft 16. Caps 163 of plastic are arranged on the ends of the shaft 27 for engagement with the levers 17.

The copying machine of the invention is very small and compact having a surface area which is only some ten centimeters longer and wider than the size of the format being copied. The height of the machine is approximately fifteen centimeters so that the copy machine altogether is only slightly greater than the size of a small briefcase. Through the above described novel arrangement of the separate elements is it possible to bring about a most compact configuration, while arranging the separate elements so that they are easily accessible for inspection and servicing. With the arrangement of the present invention, very short distances are provided between the separate elements and stations so that, in addition to the separating rollers and the pressing rollers, only two roller pairs are provided for paper transport. The drive for the photocopying machine of the present invention is very simple and is removable without the electrical installation.

Because the copies are still in the region of the charging station 5 and the exposure window 6 when they start entering the pressing rolls 9 and 10, it is preferable that a separate chain drive is provided for the pressing rolls 9, 10 and the paper copy transport rolls located in the region of the exposure window 6 namely rollers 35, 36, and 51, 52, because then the relative movement between the press rolls 9 and 10 and the occurring impacts are not carried over to the region of copy transport elements adjacent the exposure window 6. Through the relatively great distance between the driving motor and the press rollers located at opposite ends of the machine, a relatively long drive chain 77 is provided so that an occurring impact at the pressing rollers can also be absorbed by means of the elasticity of the chain.

While we have shown and described a single embodiment in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as are encompassed by the scope of the appended claims.

We claim:

1. Photocopying machine comprising:
a machine housing,
a cassette receiver in said machine housing for receiving a cassette which holds a stack of copying paper sheets,
a separating station for separating individual sheets of paper from the stack in said cassette,
a charging station for charging said sheets of paper,
an exposing station including an exposing window,
a developing station including a magnet roller,
a fixing station including a pair of pressing rollers,
a movable slide block with a holder for an original to be copied,
an optical system for transmitting images from the original to the exposing window,
and a paper reversing guide for guiding individual sheets of copying paper from the separating station to the charging station,
wherein the exit end of the paper reversing guide, the charging station, the exposing station, the developing station, and the fixing station are disposed one behind the other in said machine housing inside of the vertical projection of the length of the copying paper sheets in said cassette.

2. Photocopying machine according to claim 1, wherein the machine housing includes an upper housing part and a lower part movably mounted with respect to one another for accommodating inspection and servicing access to operating machine parts,
wherein the cassette receiver, the separating station, the charging station, the exposing station, the developing station, and the fixing station are operably supported in the lower housing part,
wherein the optical system and the slide block are operably supported in the upper housing part,
and wherein the upper housing part, together with the slideblock and the optical system, is pivotally mounted at the lower housing part.

3. Photocopying machine according to claim 2, wherein the cassette receiver is disposed adjacent to and parallel to the floor of the lower housing part, and
wherein the paper reversing guide includes means for turning the sheets of paper through a paper reversing angle greater than 180 degrees from the cassette to the inlet to the charging station.

4. Photocopying machine according to claim 3, wherein said paper reversing angle is approximately 220 degrees.

5. Photocopying machine according to claim 3, wherein the receiver for the cassette is formed out of a floor plate of the machine housing and two side guide walls arranged at the floor plate.

6. Photocopying machine according to claim 3, wherein the separating station includes a pair of separating rollers and corner separators and a lifting device for raising and lowering same.

7. Photocopying machine according to claim 6, wherein the separating station is provided with paper hold down means engageable with the stack of sheets in the cassette when the lifting device is raised.

8. Photocopying machine according to claim 6, wherein the corner separators are connected to two plates arranged at the sides adjacent the end of the receiver, the two plates being connected together by a shaft and being guided in an opening of the lower housing part and including a slot opening guide for guiding a separating roller driving shaft for separating rollers of the separating station.

9. Photocopying machine according to claim 8, wherein the separating rollers are arranged on a roller shaft pivotably carried by swing arms connected to the separating roller driving shaft, wherein a chain drive connects the roller shaft and the driving shaft, and wherein a lifting device of the separating station engages the lower shaft to lower and raise the same during sheet separating operations.

10. Photocopying machine according to claim 9, wherein the plates provided with the corner separators are supported from above by the roller shaft of the separating rollers.

11. Photocopying machine according to claim 10, wherein the lifting devices of the separating station includes a rotatable lifting shaft which grips the under side of the roller shaft by way of carrying arms movable with the lifting shaft.

12. Photocopying machine according to claim 10, wherein the lifting shaft engages a paper hold down member by means of a sheet spring arranged in a fork shaped opening.

13. Photocopying machine according to claim 3, wherein the reversing guide is formed as a closed channel of decreasing cross sectional size in the direction toward its exit end, and wherein draw-off rollers are disposed immediately after the exit end of the reversing guide and immediately before the charging station.

14. Photocopying machine according to claim 13, wherein the channel includes an outer shell of plastic guidingly engageable with the coated side of the sheets of copying paper, and an inner shell preferably of electricity conducting material, guidingly engageable with the uncoated sides of the sheets.

15. Photocopying machine according to claim 14, wherein the outer shell is provided with a plurality of guide ribs extending in the paper transport direction.

16. Photocopying machine according to claim 15, wherein the inner shell is provided with a plurality of ribs extending transversely to the paper transport direction.

17. Photocopying machine according to claim 13, wherein the reversing guide is constructed as a unit which is detachably mountable with protrusions in openings in the floor plate of the housing lower part and in openings in sidewalls of the housing lower part.

18. Photocopying machine according to claim 3, wherein the charging station and the exposing window are immediately adjacent one another in facing relationship to a common paper guide plate.

19. Photocopying machine according to claim 18, wherein the charging station and the exposing window are constructed as a unit which is detachably mounted from above in openings in sidewalls of the lower housing part.

20. Photocopying machine according to claim 19, wherein the charging station and the exposing window are accommodated in a two section housing, the first section containing the charging station and having only the guide plate opposite an open side, the second section exhibiting only an upwardly and downwardly open frame.

21. Photocopying machine according to claim 20, wherein nylon threads are stretched over the side of the two section housing facing the guide plate.

22. Photocopying machine according to claim 18, wherein the electrical current supply circuit for the charging station is arranged in the housing upper part and exhibits a resilient contact engageable with the contacts at the charging station.

23. Photocopying machine according to claim 19, wherein paper transport means are provided which includes a drawoff roller pair in front of the charging station and exposing window, and a transport roller pair disposed after the exposing window, the transport path of the draw-off roller pair and the transport roller pair being aligned with the guide plate.

24. Photocopying machine according to claim 3, wherein the developing station is formed as a construction unit with a common housing forming a reservoir for toner and a receiver for a magnetic roller, wherein a preferably adjustable paper guide plate is provided at said common housing, and wherein the common housing with bearings for the magnetic roller are insertable from above in openings of side walls of the lower machine housing part.

25. Photocopying machine according to claim 24, wherein an elastic or elastically held cover is provided at the upper machine housing part for covering a filling opening of the reservoir.

26. Photocopying machine according to claim 3, wherein two elastically deformable bearing blocks are provided at the lower machine housing part for the pressing rollers, said bearing blocks each being constructed as one part units with shell formed bearing seats for the bearings of the upper and lower pressing rollers.

27. Photocopying machine according to claim 26, wherein each bearing block is provided with a slot in the region of the bearing seats, in which region shoulders are provided which are elastically connected by a spring.

28. Photocopying machine according to claim 3, wherein the slide block for holding originals to be copied carries a glass plate extending in the longitudinal direction of the machine, one side of the glass plate laying on a longitudinally extending carrying rail guided at the upper side of the machine housing upper part.

29. Photocopying machine according to claim 28, wherein the clamping plate is clamped by means of a clamping ledge, together with a pressing cover of rubber/elastic material, to the carrying rail.

30. Photocopying machine according to claim 29, wherein the slideblock is driven by an endless chain by means of a driving member engageable with a slideblock bracket.

31. Photocopying machine according to claim 3, wherein a common driving motor is provided for driving all of the slideblock, the separating rollers and their lifting device, the draw-off rollers, the magnetic roller of the developing station and the pressing rollers.

32. Photocopying machine according to claim 31, wherein the drive motor drives the pressing rollers and the magnetic roller by means of a first chain drive, wherein the drive motor drives the draw-off rollers, the transport rollers and the chain for moving the slideblock by means of a second chain drive, and wherein the drive of the separating rollers from the draw-off rollers and the lifting device is operable by a carriage movably mounted on the slide block.

33. Photocopying machine according to claim 32, wherein the driving motor and the pressing rollers are disposed at opposite ends of the machine housing lower part.

34. Photocopying machine according to claim 32, wherein the driving draw-off roller is connected to the chain drive by a coupling, which coupling is opened by an oncoming sheet engaging a touch switch at one of the draw-off rollers and is closed by activating a switch by means of a movable carriage as a function of a predetermined position of the slideblock.

35. Photocopying machine according to claim 34, wherein the driving motor is activated by a start switch, and wherein further switching elements are provided which are activated in dependance on the position of the slideblock for controlling the duration the driving motor is on and for controlling the activation of a lamp, the separating station and the draw-off rollers.

36. Photocopying machine according to claim 35, wherein the start switch serves to set the number of copies selected, the start switch being reverse switched one unit by an attached lever mechanism upon each cycle of movement of the slideblock.

37. Photocopying machine comprising:

a machine housing, a receiver in said machine housing for receiving copying paper, a separating station for separating individual sheets of paper from said copying paper, a charging station for charging said sheets of paper, an exposing station including an exposing window, a movable slide block with a holder for an original to be copied, an optical system for transmitting images from the original to the exposing window, a developing station including a magnet roller, a fixing station including a pair of pressing rollers, wherein two elastically deformable bearing blocks are provided at the lower machine housing part for the pressing rollers, said bearing blocks each being constructed as one part units with shell formed bearing seats for the bearings of the upper and lower pressing rollers.

38. Photocopying machine according to claim 37, wherein each bearing block is provided with a slot in the region of the bearing seats, in which region shoulders are provided which are elastically connected by a spring.

* * * * *